US006014775A

United States Patent [19]

Missry

[11] Patent Number: 6,014,775

[45] Date of Patent: Jan. 18, 2000

[54] MAGNETIC GOLF GLOVE

[75] Inventor: Ezra Missry, Deal, N.J.

[73] Assignee: Misco Enterprises, Inc., Dunellen, N.J.

[21] Appl. No.: 09/303,594

[22] Filed: May 3, 1999

[51] Int. Cl.[7] ..... A41D 19/00

[52] U.S. Cl. ..... 2/161.2; 2/162; 473/205; 600/15

[58] Field of Search ..... 2/159, 161.1, 161.2, 2/161.4, 161.5, 162, 917; 473/205; 600/9, 15

[56] References Cited

U.S. PATENT DOCUMENTS

| | | | |
|---|---|---|---|
| 4,094,587 | 6/1978 | Ishikawa | 128/1.3 |
| 4,905,335 | 3/1990 | Tervola | 7/169 |
| 5,720,046 | 2/1998 | Lopez et al. | 2/159 |
| 5,802,615 | 9/1998 | Wenk | 2/161.2 |
| 5,827,170 | 10/1998 | Gebran | 600/15 |

*Primary Examiner*—Diana Oleksa
*Assistant Examiner*—Katherine Moran
*Attorney, Agent, or Firm*—Bauer & Schaffer, LLP

[57] ABSTRACT

An improved golf glove of a type having a pinkie engaging portion for engaging the pinkie, a ring finger engaging portion for engaging the ring finger, a middle finger engaging portion for engaging the middle finger, an index finger engaging portion for engaging the index finger, a thumb engaging portion for engaging the thumb, a palm engaging portion for engaging the palm, a back hand engaging portion for engaging the back of the hand, a wrist engaging portion for engaging the wrist and has a throughslot that extends longitudinally along the back of the hand portion, a fastening flap fixedly attached at a fixed edge to the back of the hand portion to one side of the throughslot and extending therefrom over the throughslot to the back of the hand portion on the other side of the throughslot where it is selectively maintained thereagainst by mating portions of hook and loop fasteners. The improvement includes a pair of magnets contained in the fastening flap. The pair of magnets serve accelerate blood flow in the ulnar artery, the pisiform bone, and the ulnar nerve. The improved blood flow acts in a therapeutic manner while at the same time improving feel during play.

7 Claims, 2 Drawing Sheets

MAGNETIC GOLF GLOVE

BACKGROUND OF THE INVENTION

1. Field of the Invention

The present invention relates to a golf glove. More particularly, the present invention relates to an improved golf glove having magnets therein to increase blood flow and improve circulation in the hand.

2. Description of the Prior Art

Innovations for golf gloves have been provided in the prior art. Even though these innovations may be suitable for the specific individual purposes to which they address, however, they differ from the present invention.

FOR EXAMPLE, a typical golf glove 10 is taught by U.S. Pat. No. Des. 362,105 to Malloy et al., which can best be seen in FIGS. 1 and 2, which are, respectively, a diagrammatic top plan view of a typical prior art golf glove, and a diagrammatic bottom plan view of the typical prior art golf glove shown in FIG. 1, and as such, will be discussed with reference thereto.

The golf glove 10 comprises a pinkie engaging portion 12 for engaging the pinkie 14, a ring finger engaging portion 16 for engaging the ring finger 18, a middle finger engaging portion 20 for engaging the middle finger 22, an index finger engaging portion 24 for engaging the index finger 26 and a thumb engaging portion 28 for engaging the thumb 30.

The golf glove 10 further comprises a palm engaging portion 32 for engaging the palm 34, a back hand engaging portion 36 for engaging the back of the hand 38 and a wrist engaging portion 40 for engaging the wrist 42.

The wrist engaging portion 40 has a throughslot 44 that extends longitudinally along the back of the hand portion 36 for assisting in donning the glove 10.

The golf glove 10 further comprises a fastening flap 46 fixedly attached at a fixed edge 47 to the back of the hand portion 36 to one side of the throughslot 44 and extends over the throughslot 44 to the back of the hand portion 36 on the other side of the throughslot 44 where it is selectively maintained thereagainst by mating portions of hook and loop fasteners 48.

The golf glove 10 further comprises at least one ball spot marker 50 that is selectively attached on the wrist engaging portion 40, adjacent the throughslot 44.

Even though the innovations may be suitable for the specific individual purposes to which they address, however, they would not be suitable for the purposes of the present invention as heretofore described.

Conventional golf gloves of the type described above do not improve circulation, reduce swelling or otherwise act in the prevention or healing of injuries. Further, the gloves found in the prior art do not serve to enhance the touch or feel of the player during by improving circulation and/or increasing blood flow in the fingers and hand.

It is therefore, an object of the present invention is to provide an improved golf glove that avoids the disadvantages of the prior art.

It is another object of the present invention to provide a glove that aids in the prevention and healing of injuries.

It is still another object of the present invention to enhance the touch and feel of the golfer during play by improving circulation of blood in the fingers and hand.

It is yet another object to provide an improved golf glove that is simple and inexpensive to manufacture.

It is a further object of the present invention is to provide an improved golf glove that is simple to use.

SUMMARY OF THE INVENTION

In accordance with the stated objectives the present invention provides an improved golf glove of a type having a pinkie engaging portion for engaging the pinkie, a ring finger engaging portion for engaging the ring finger, a middle finger engaging portion for engaging the middle finger, an index finger engaging portion for engaging the index finger, a thumb engaging portion for engaging the thumb, a palm engaging portion for engaging the palm, a back hand engaging portion for engaging the back of the hand, a wrist engaging portion for engaging the wrist and having a throughslot that extends longitudinally therefrom along the back of the hand portion, a fastening flap fixedly attached at a fixed edge to the back of the hand portion to one side of the throughslot and extending freely therefrom over the throughslot to the back of the hand portion on the other side of the throughslot where it is selectively maintained thereagainst by mating portions of hook and loop fasteners, and at least one ball spot marker that is selectively attached on the wrist engaging portion, adjacent the throughslot. The improvement includes a pair of magnets contained in the fastening flap. This has the effect of improving blood flow in the ulnar artery, the pisiform bone, and the ulnar nerve. The improved blood flow acts in a therapeutic manner while at the same time improving feel during play.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

DETAILED DESCRIPTION OF THE PREFERRED EMBODIMENT

Figure 1:
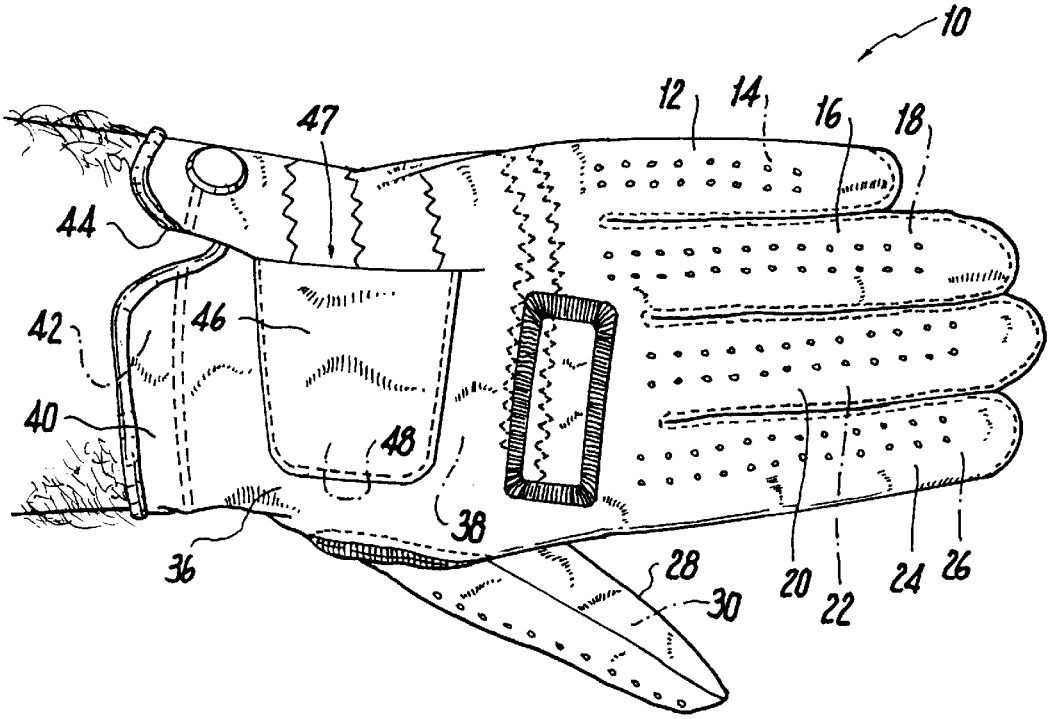
Fig. 1 Prior Art
FIG. 1 is a diagrammatic top plan view of a typical prior art golf glove.
Figure 2:
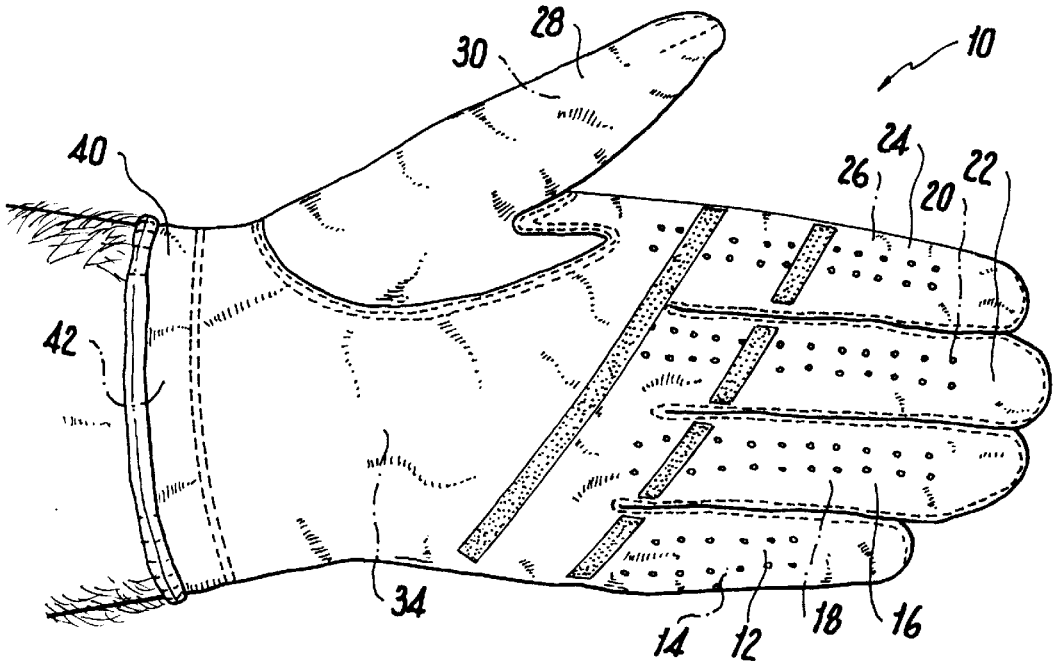
Fig. 2 Prior Art
FIG. 2 is a diagrammatic bottom plan view of the typical prior art golf glove shown in FIG. 1.
Figure 3:
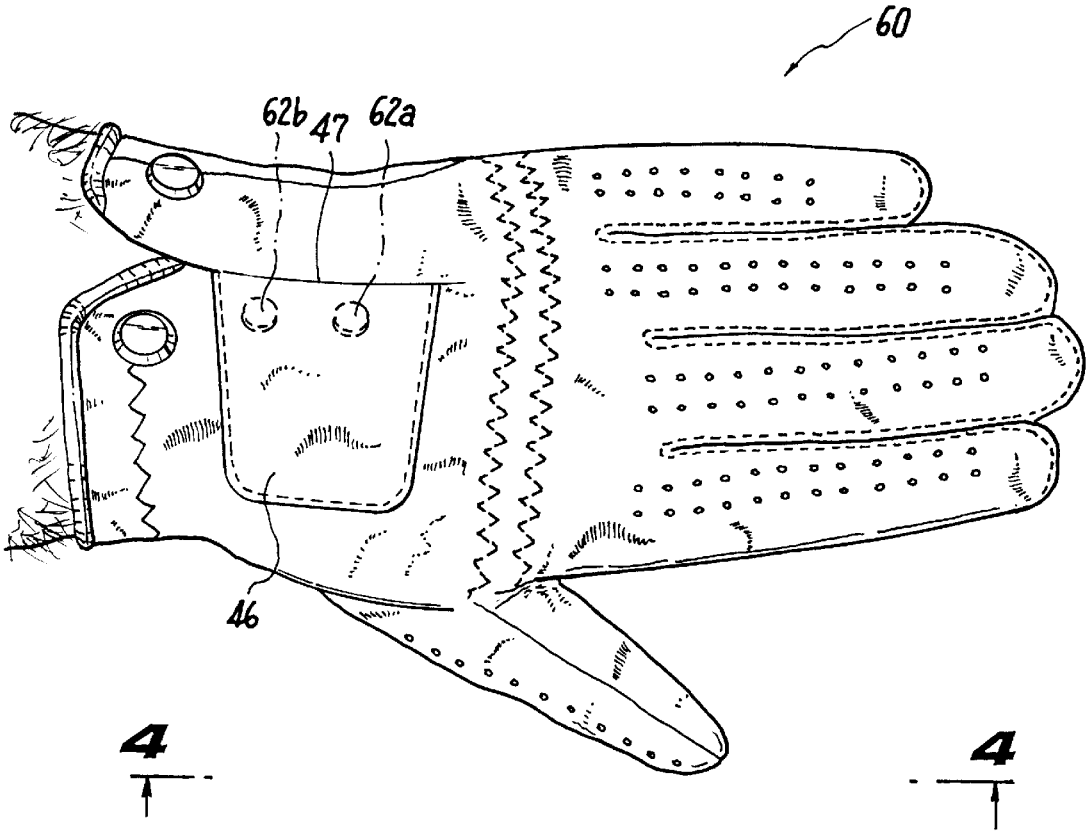
FIG. 3 is a diagrammatic top plan view of the present invention.

Referring now to the figures, in which like numerals indicate like parts, and particularly to FIG. 3, which is a diagrammatic top plan view of the improved golf glove according to present invention generally depicted by the numeral 60.

Figure 4:
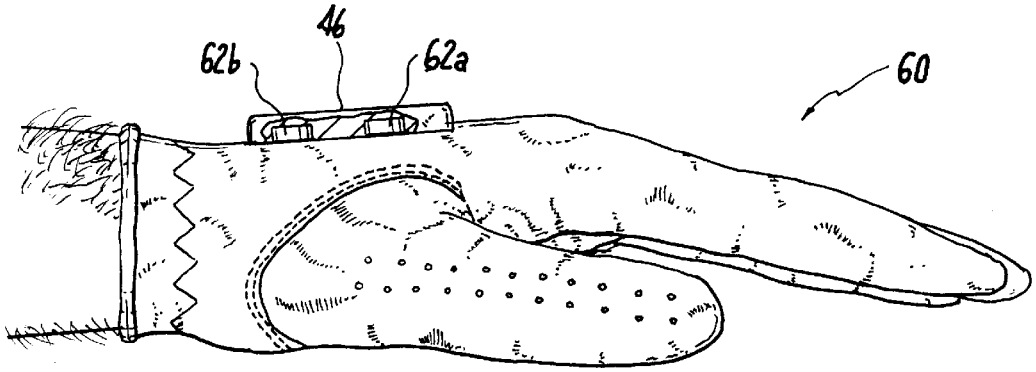
FIG. 4 is a diagrammatic side elevational view taken generally in the direction of ARROW 4 in FIG. 3, with the fastening flap being longitudinally sectioned.

The configuration of the improved golf glove 60 can best be seen in FIGS. 3 and 4, which are, respectively, again a diagrammatic top plan view of the present invention, and a diagrammatic side elevational view taken generally in the direction of ARROW 4 in FIG. 3, with the fastening flap being longitudinally sectioned, and as such, will be discussed with reference thereto.

The improved golf glove 60 comprises a first and second magnets, 62*a* and 62*b* contained in the fastening flap 46.

The pair of magnets 62*a* and 62*b* are spaced apart and aligned, with each magnet positioned in close proximity to the fixed edge 47 of the fastening flap 46.

Each magnet 62*a* and 62*b* is disk-shaped and lays flat in the fastening flap 46. Further, each magnet is positioned so that it overlies the ulnar artery, the pisiform bone, and the ulnar nerve in the back of the hand 38.

In a first embodiment of the present invention each magnet 62*a* and 62*b* is orientated so that the north pole thereof faces the back of the hand 38 wrist thereby attracting the iron in the white blood cells toward the magnet. This has the effect of drawing the non-oxygenated blood towards the magnet allowing oxygenated blood to flow freely into the hand and fingers of the golfer. This has the therapeutic effect of improving blood flow to the region while at the same time improving the feel of the golfer during play.

In a second embodiment of the present invention one magnet 62*a* closest to the fingers 14, 18, 22, 26, and 30 has a South Pole facing the back of the hand 38 of the hand and the other magnet 62*b* has a North Pole facing the back of the hand 38 so as to create lines of force from the magnet 62*b* forwardly to magnet 62*a* through the hand thereby increasing blood flow and circulation in the ulnar artery, the pisiform bone, and the ulnar nerve.

A separate inner wrist fastening flap, containing a pair of magnets in like configuration as described regarding the fastening flap 46, either in addition to or in place of fastening flap 46, can be fixed to the palm engaging portion of the glove. The inner wrist fastening flap can be positioned such that the magnetic fields generated by the magnets mounted within would be directed to the inner wrist of the user thereby targeting the blood vessels and nerves in the wrist, including the ulnar artery and ulnar nerve, from a closer and different vantage point. Alternatively, the inner wrist fastening flap could be positioned to work in conjunction with the fastening flap 46 on the back of the hand portion. The poles of the magnets could be configured in a variety of ways including N- and S-poles at opposite placement to each other with one pole at the palm engaging portion and the other pole at the back of the hand engaging portion.

This configuration could include a single magnet or multiple magnets in each flap. Another configuration could include N- and S-poles formed on the one side of each magnet which is facing the user's hand or wrist.

It will be understood that each of the elements described above, or two or more together, may also find a useful application in other types of constructions differing from the types described above.

While the invention has been illustrated and described as embodied in an improved golf glove, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An improved golf glove of a type having a back hand engaging portion for engaging the back of the hand, a wrist engaging portion for engaging the wrist, a throughslot that extends longitudinally along the back of the hand portion, a fastening flap fixedly attached at a fixed edge to the back of the hand portion along one side of the throughslot and extending therefrom over the throughslot to the back of the hand portion on the other side of the throughslot where it is selectively maintained thereagainst, said improvement comprising a first and second magnet contained in the fastening flap.

2. The improved golf glove as defined in claim 1, wherein said first and second magnets are spaced apart and aligned, with each magnet located in close proximity to the fixed edge of the fastening flap.

3. The improved golf glove as defined in claim 1, wherein each magnet is disk-shaped and lays flat within the fastening flap.

4. The improved golf glove as defined in claim 1, wherein each of said magnets overlie the ulnar artery, the pisiform bone, and the ulnar nerve in the back of the hand.

5. The improved golf glove as defined in claim 1, wherein said first magnet includes a first North Pole facing the back of the hand and said second magnet includes a second North Pole facing the back of the hand.

6. The improved golf glove as defined in claim 1, wherein said first magnet includes a first magnet closest to the fingers having a South Pole facing the back of the hand of the hand and a second magnet having a North Pole facing the back of the hand so as to create lines of force from said second magnet to said first magnet.

7. The improved golf glove as defined in claim 6, wherein said first magnet and said second magnet are aligned to one another and to the ulnar artery to thereby improve blood flow.

* * * * *